US010259690B2

(12) United States Patent
Franke

(10) Patent No.: US 10,259,690 B2
(45) Date of Patent: Apr. 16, 2019

(54) GRIPPER AND CROSS-MEMBER HAVING AT LEAST ONE GRIPPER

(71) Applicant: GKS Stahl- und Maschinenbau GmbH, Langenfeld (DE)

(72) Inventor: Boris Franke, Heinsberg (DE)

(73) Assignee: GKS Stahl- und Maschinenbau GmbH, Langenfeld (DE)

( * ) Notice: Subject to any disclaimer, the term of this patent is extended or adjusted under 35 U.S.C. 154(b) by 0 days.

(21) Appl. No.: 15/915,298

(22) Filed: Mar. 8, 2018

(65) Prior Publication Data

US 2018/0257914 A1 Sep. 13, 2018

(30) Foreign Application Priority Data

Mar. 8, 2017 (DE) ..... 10 2017 002 138

(51) Int. Cl.
*B66C 1/44* (2006.01)
*B66C 1/10* (2006.01)
*B66C 1/24* (2006.01)

(52) U.S. Cl.
CPC ..... *B66C 1/44* (2013.01); *B66C 1/108* (2013.01); *B66C 1/24* (2013.01); *B66C 1/445* (2013.01)

(58) Field of Classification Search
CPC .. B66C 1/108; B66C 1/22; B66C 1/42; B66C 1/44; B66C 1/445; B66C 1/24
USPC ... 294/67.1, 67.2, 67.21, 67.22, 81.6, 81.61, 294/81.62, 81.2, 81.21
See application file for complete search history.

(56) References Cited

U.S. PATENT DOCUMENTS 3,998,488 A * 12/1976 Durgan ..... B66C 1/10 294/67.21
4,181,341 A * 1/1980 Henke ..... B66C 1/24 294/103.1
4,722,106 A * 2/1988 Scegiel ..... A01K 55/00 294/67.2
4,973,094 A * 11/1990 Tana ..... B66C 1/28 114/44
6,733,058 B1 * 5/2004 Nakajima ..... B65H 19/123 242/559.1

(Continued)

FOREIGN PATENT DOCUMENTS

DE 102015105178 A1 5/2016
DE 102015008610 B3 12/2016
EP 2873641 A1 5/2015

*Primary Examiner* — Dean J Kramer
(74) *Attorney, Agent, or Firm* — Patent Central LLC; Stephan A. Pendorf

(57) ABSTRACT

A C-gripper for arranging at a cross-member or at a suspension element and a cross-member having at least one such C-gripper for for handling a load, formed from an upper strut, a vertical strut and a support strut which forms a so-called hook base, onto which the load can be placed. The upper strut and the vertical strut are, as with conventional constructions, rigidly connected to one another and substantially arranged at right angles to one another. Other angles likewise lie within the framework of the invention. However, the support strut is not rigid, but rather connected in a rotatably mounted manner to the vertical strut and, indeed, in such a manner that a clear dimension (h) of a mouth of the C-gripper can be modified, that is to say can be increased or decreased. Moreover, the vertical strut is telescopable. It is thus configured as a telescopic strut.

12 Claims, 2 Drawing Sheets

(56) References Cited

U.S. PATENT DOCUMENTS

| | | | | |
|---|---|---|---|---|
| 2012/0032125 | A1* | 2/2012 | Diaz De Corcuera | B66C 1/108 254/131 |
| 2012/0098283 | A1 | 4/2012 | Maj et al. | |
| 2015/0028608 | A1* | 1/2015 | Wubbelmann | B66C 1/447 294/81.2 |
| 2015/0028610 | A1* | 1/2015 | Hansen | B66C 1/108 294/81.55 |

* cited by examiner

GRIPPER AND CROSS-MEMBER HAVING AT LEAST ONE GRIPPER

BACKGROUND OF THE INVENTION

Field of the Invention

The invention relates to a C-gripper for arranging at a cross-member or at a suspension element and a cross-member having at least one such C-gripper for transporting loads, wherein the height of the C-gripper is adjustable.

Description of the Related Art

C-grippers have been known for many years, including for instance from EP2873641 A1 amongst others. The C-gripper disclosed therein is a C-gripper having a rigid structure. This resulted in disadvantages during transportation in the past. Of course, such grippers cannot, as a general rule, be loaded into a standard container, since it is particularly advantageous during use on ships, that is to say for example during the erection of offshore wind turbines, if such a gripper or respectively a cross-member having at least one such gripper is to be used. In addition, there is the problem with conventional rigid C-grippers or respectively C-elements that the largest loads, and therefore the highest potential for damage, occur(s) in corner areas of a vertical strut, also called spines.

Accordingly, the object of the invention entails providing a C-gripper or respectively a cross-member having at least one such C-gripper, the spatial volume of which can be reduced or respectively the usually rigid form thereof, that is to say its height, can be modified. Another object entails reducing the potential for damage in the corner areas of the vertical strut.

BRIEF SUMMARY OF THE INVENTION

The object is achieved according to the invention by a height-adjustable C-gripper, and a cross-member having at least one such C-gripper The dependent subclaims include more detailed configurations of the invention.

According to this, a C-gripper is provided for handling a load which is intended to be arranged at a cross-member or at a suspension element, that is to say a crane hook for example, formed from an upper strut, a vertical strut and a support strut which forms a so-called hook base, onto which the load can be placed, wherein the term 'placing on' within the meaning of the invention can, in addition to placing on as such, also be a suspended supporting of the load at the support strut. The load is, in this respect, arranged on or at the support strut. The upper strut and the vertical strut are, as with conventional constructions, rigidly connected to one another and substantially arranged at right angles to one another, wherein other angles likewise lie within the framework of the invention. However, the support strut is not rigid, but rather connected in a rotatably mounted manner to the vertical strut and, indeed, in such a manner that a clear dimension (h) of a mouth of the C-gripper can be modified, that is to say it can be increased or decreased. Moreoever, the vertical strut is telescopable. It is thus configured as a telescopic strut.

The telescopable vertical strut is locked by means of a known holding device such as, for example, by at least one bolt per segment or similar holding devices. All devices which afford a functionally reliable locking are considered.

According to the invention, the rotatably mounted support strut is locked, that is to say the clear dimension (h) of the mouth and, therefore, also the regulation of the rotational movement, is adjusted by means of at least one non-rigid loading means which, displaced relative to the vertical strut in the direction of the mouth of the C-gripper, is arranged in a functionally reliable manner at the upper strut and the support strut. The at least one non-rigid loading means, which is displaced parallel to the vertical strut in the direction of the mouth of the C-gripper, is preferably arranged in a functionally reliable manner at the upper strut and the support strut. The at least one non-rigid loading means is, for example, a sling having rotatably mounted receptacles such as, for example, pulleys, at the upper strut and the support strut and the length of which can be modified such as, for example, by means of winches, windlasses or other known suitable devices.

The displacement is effected to the extent that is constructively necessary. It can be effected variably according to the construction and the nature of the load.

The rotatably mounted support strut is advantageously connected at its own free end to a free end of the vertical strut. The clear dimension (h) of the mouth is advantageously adjusted in such a manner that the support strut is arranged at a right angle to the telescopic strut. However, other angle dimensions also lie within the field of the invention, inasmuch as the functionality of the C-gripper is not adversely affected.

In addition, it should be noted that the upper strut, the vertical strut and the support strut do not only denote, within the meaning of the invention, a single strut, but can also represent various struts or other constructive arrangements.

However, in the overall view of the device, these form, in each case, one component which can be correspondingly defined as the upper strut, vertical strut or support strut.

The device according to the invention can consequently be modified with respect to the height of the C-gripper so that optimized transport is possible. Furthermore, during use with the load, the telescopable vertical strut simply absorbs the compression forces in the locking position, wherein the tensile forces are absorbed by the at least one non-rigid loading means. This construction makes it possible to reduce the vertical strut with regard to its thickness and, consequently, save weight. Moreover, the corner areas of the vertical strut are significantly less stressed by the construction according to the invention when the C-gripper is used, so that the potential for damage in these areas is reduced as it were.

In another configuration, the support strut has multiple height-adjustable segments in order to adapt to the outer geometry of the load, that is to say of a rotor blade or other component of a wind turbine, which segments extend into the mouth of the C-gripper.

The upper strut can additionally have a known clamping device which can be displaced relative to the support strut and which points into the mouth of the C-gripper, in order to be able to lock the load. The clamping device itself is arranged offset to the vertical strut in the direction of the mouth and to the at least one non-rigid loading means at the upper strut, and can be displaced in the direction of the support strut so that a force can be exerted on the load in the locking position, which force prevents or respectively minimizes a slippage of the same.

During use, the at least one non-rigid loading means is then also tensed in the locking position, because this, as already stated, absorbs the tensile forces acting on the C-gripper, that is to say the support strut and the vertical strut. The at least one non-rigid loading means is, however, tensed as it were, if the load is simply arranged with its dead weight on or at the support strut and, consequently, a tensioning of the at least one non-rigid loading means is produced because of the dead weight of the load.

In the pushed-together state of the C-gripper, the at least one non-rigid loading means can additionally be removed and stowed. The support cross-member can then be locked by means of a rigid strut.

Likewise, the invention relates to a cross-member such as, for example, a beam cross-member, for handling a load, wherein the cross-member has at least one of the previously described C-grippers. The cross-member can likewise be arranged in the known way like the C-gripper itself at or on multiple suspension elements of a crane-like hoist. The cross-member preferably has two C-grippers at its free ends, which are removable, in order to be able to transport an elongated load like a rotor blade of a wind turbine. Transporting elongated loads is, as it were, possible when at least two C-grippers are used.

The ability to remove the at least one C-gripper is advantageous if the cross-member having the C-grippers according to the invention is to be put, dismantled, into a standard container. In such a case, it is composed of at least two segments which are rotatably mounted with respect to one another, which make it possible to fold the cross-member and to thus shorten its length. The at least two segments are, in each case, preferably connected to one another in a rotatably mounted manner at narrow sides.

The foldability or respectively possibility of dismantling the cross-member and the at least one C-gripper, preferably two C-grippers, including the possibility of decreasing the height of the at least one C-gripper, makes it possible to transport the device, for which the spatial volume occupied by it can be reduced. This guarantees advantages during transport, which are reflected not least in a reduction of transport costs as well.

BRIEF DESCRIPTION OF THE SEVERAL VIEWS OF THE DRAWINGS

The invention will be explained in greater detail below on the basis of an embodiment example, with reference to the figures. Further advantages, features and configurations of the invention are set out, wherein.

DETAILED DESCRIPTION OF THE INVENTION

Figure 1:
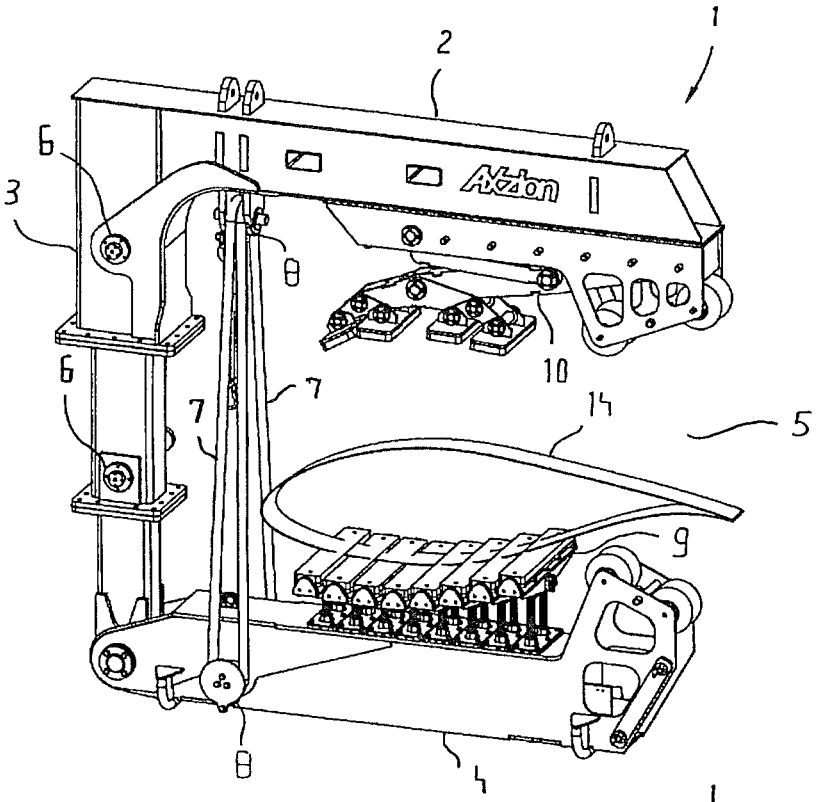
FIG. 1 shows a C-gripper according to the invention in an oblique perspective, having a load in the open position.
Figure 2:
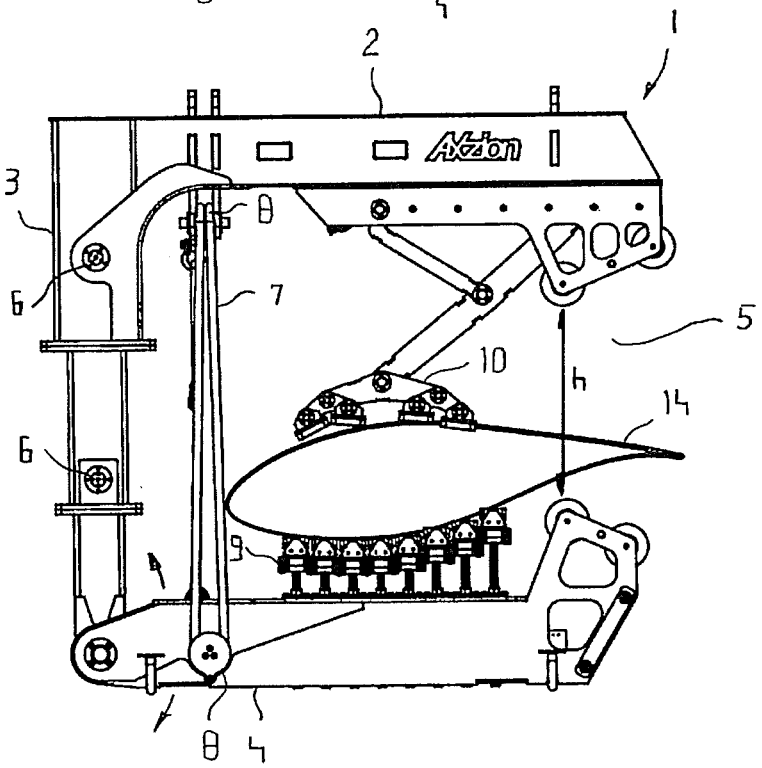
FIG. 2 shows a C-gripper according to the invention in a lateral view, having a load in the locking position.

FIG. 1 shows a C-gripper 1 which can be arranged at a cross-member 11. The C-gripper 1 consists of an upper strut 2, a vertical strut 3 and a support strut 4. The support strut 4 has multiple support segments 9 and forms a so-called hook base, onto which the load 14 can be placed. The upper strut 2 and the vertical strut 3 are, as with conventional constructions, rigidly connected to one another and are arranged at right angles to one another. The support strut 4 is not rigid, but connected to the vertical strut 3 in a rotatably mounted manner and, indeed, in such a manner that a clear dimension (h) of a mouth 5 of the C-gripper 1 can be modified, that is to say it can be increased or decreased. The support strut 4 can consequently be swiveled, which is characterized in FIG. 2 by the arrows. Moreover, the vertical strut 3 can be telescoped, in the embodiment example it can be telescoped twice.

The telescopable vertical strut 3 is locked by means of two holding devices 6, that is to say by one bolt per segment. According to the invention, the rotatably mounted support strut is locked, that is to say the clear dimension (h) of the mouth is adjusted, by means of a non-rigid loading means 7 which, displaced relative to the vertical strut 3 in the direction of the mouth 5 of the C-gripper 1, is fastened at the upper strut 2 and the support strut 4 by means of rotatable receptacles 8. The non-rigid loading means 7 which, in this case is displaced parallel to the vertical strut 3 in the direction of the mouth 5 of the C-gripper 1, is fastened at the upper strut 2 and the support strut 4. The non-rigid loading means 7 is, in the embodiment example, a sling and is arranged at rotatably mounted receptacles 8, namely pulleys, at the upper strut 2 and the support strut 4.

Its length can be modified. The support strut and vertical strut are, however, arranged at a right angle to one another in the embodiment example.

The upper strut 2 has a known clamping device 10 which can be displaced relative to the support strut 4 and which points into the mouth 5 of the C-gripper 1, in order to be able to lock the load 14. The clamping device 10 itself is arranged offset to the vertical strut 3 and to the non-rigid loading means 7 in the direction of the mouth 5 at the upper strut 2 and can be displaced in the direction of the support strut 9, so that in the locking position a force can be exerted onto the load 14, which prevents or respectively minimizes a slippage of the same. During use, the non-rigid loading means 7 is likewise tensed in the locking position. It then absorbs the tensile forces acting on the C-gripper 1, that is to say the support strut 4 and the vertical strut 3, FIG. 2. The non-rigid loading means 7 is, however, tensed as it were, if the load 14 with its dead weight simply rests on the support strut 4 and, consequently, a tensioning of the non-rigid loading means 7 is produced because of the dead weight of the load 14, FIG. 1.

Figure 3:
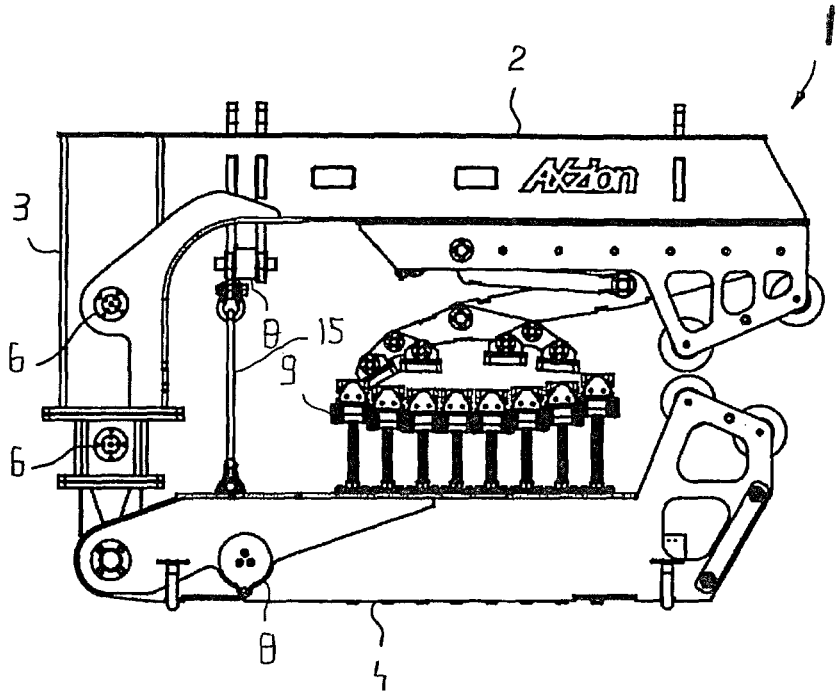
FIG. 3 shows a C-gripper according to the invention in a lateral view, telescoped in a transport position.

In a volume-minimized state of the C-gripper 1, elements of the vertical strut 3 are pushed together. In addition, the non-rigid loading means 7 is removed. The support cross-member is then locked by means of a rigid strut 15, FIG. 3.

Figure 4:
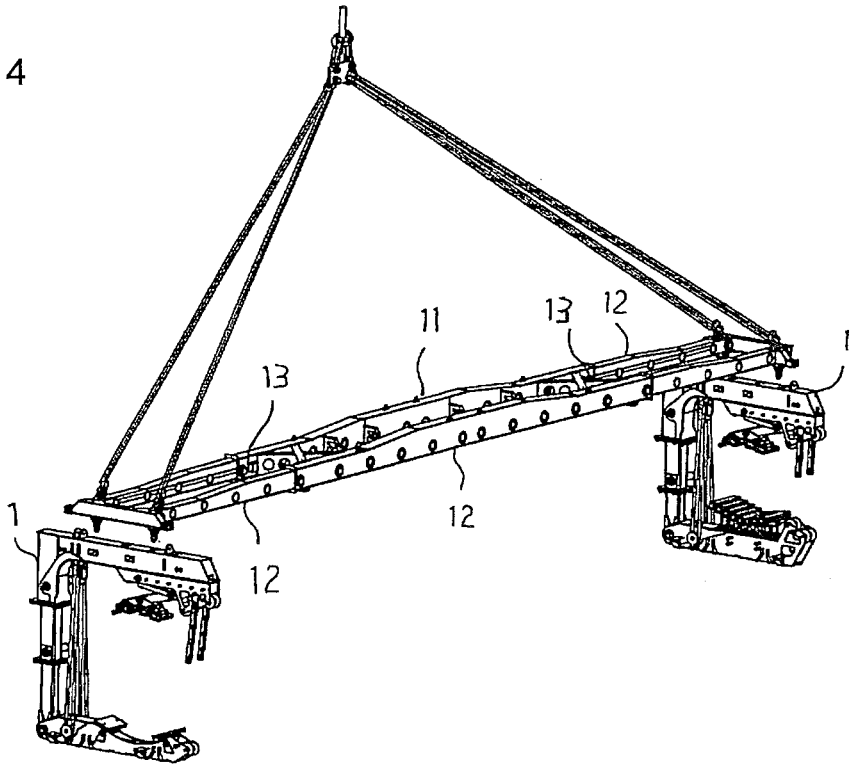
FIG. 4 shows a cross-member according to the invention, having two C-grippers arranged at the edge in an oblique perspective.

In FIG. 4, a cross-member 11 consisting of three segments 12 is illustrated, which is arranged by means of lifting straps at a suspension element of a crane for handling a rotor blade of a wind turbine. The segments are arranged swivelably with respect to one another on respective narrow sides 13. The cross-member 11 has respectively a C-gripper 1 at its free ends. These can be removed, in order to be able to stow the cross-member 11 having the C-grippers 1 according to the invention in a standard container. In such a case, the cross-member 11 composed of the three segments 12, which are rotatably mounted with respect to one another, can be folded. This guarantees a space-saving storage of the cross-member. The cross-member 11 having its two C-grippers 1 is suitable for transporting elongated loads like, for instance, tower segments or rotor blades of wind turbines.

LIST OF REFERENCE NUMERALS

1. C-gripper
2. Upper strut

3. Vertical strut
4. Support strut
5. Mouth
6. Holding device
7. Non-rigid loading means
8. Receptacles
9. Support segments
10. Clamping device
11. Cross-member
12. Segments
13. Narrow sides
14. Load
15. Strut

The invention claimed is:

1. A C-gripper (1) for handling a load (14), including
an upper strut (2), a vertical strut (3) and a support strut (4), on or at which the load (14) can be arranged, wherein
the upper strut (2) and the vertical strut (3) are rigidly connected to one another;
the support strut (4) is connected in a rotatably mounted manner to the vertical strut (3), so that a clear dimension (h) of a mouth (5) of the C-gripper (1) can be modified;
the vertical strut (3) is telescopable;
the telescopable vertical strut (3) is locked by means of a holding device (6); and
the rotatably mounted support strut (4) is locked by means of at least one non-rigid loading means (7) which, displaced relative to the vertical strut (3) in the direction of the mouth (4) of the C-gripper (1), is arranged at the upper strut (2) and the support strut (4).

2. The C-gripper (1) according to claim 1, wherein the at least one non-rigid loading means (7) is a sling having rotatably mounted receptacles (8) at the upper strut (2) and the support strut (4).

3. The C-gripper (1) according to claim 1, wherein the length of the at least one non-rigid loading means (7) is adjustable.

4. The C-gripper (1) according to claim 1, wherein the support strut (4) has multiple height-adjustable support segments (9) in order to adapt to the outer geometry of the load (14), which support segments extend into the mouth (5) of the C-gripper (1).

5. The C-gripper (1) according to claim 1, wherein the upper strut (2) has a clamping device (10) which can be displaced relative to the support strut (4) and which points into the mouth (5) of the C-gripper (1), in order to lock a load (14).

6. The C-gripper (1) according to claim 5, wherein the clamping device (10) is arranged offset to the vertical strut (3) in the direction of the mouth (5) and to the at least one non-rigid loading means (7) at the upper strut (2), and can be displaced in the direction of the support strut (4).

7. A cross-member (11) for handling a load, wherein the cross-member (11) has at least one C-gripper (1) according to claim 1.

8. The cross-member (11) according to claim 7, wherein the cross-member (11) has two C-grippers (1) at its free ends.

9. The cross-member (11) according to claim 7, wherein the cross-member (11) is composed of at least two segments (12) which are rotatably mounted with respect to one another.

10. The cross-member (11) according to claim 9, wherein the at least two segments (12) are each connected to one another in a rotatably mounted manner at narrow sides (13) are adapted to be folded.

11. A C-gripper (1) for handling a load (14), including
an upper strut (2), a vertical strut (3) and a support strut (4), on or at which the load (14) can be arranged, wherein
the upper strut (2) and the vertical strut (3) are rigidly connected to one another;
the support strut (4) is connected in a rotatably mounted manner to the vertical strut (3), so that a clear dimension (h) of a mouth (5) of the C-gripper (1) can be modified;
the vertical strut (3) is telescopable;
the telescopable vertical strut (3) is locked by means of a holding device (6); and
the rotatably mounted support strut (4) is locked by means of at least one non-rigid loading means (7) which, displaced relative to the vertical strut (3) in the direction of the mouth (4) of the C-gripper (1), is arranged at the upper strut (2) and the support strut (4); and
the at least one non-rigid loading means (7) which, displaced parallel to the vertical strut (3) in the direction of the mouth (5) of the C-gripper (1), is arranged at the upper strut (2) and the support strut (4).

12. A C-gripper (1) for handling a load (14), including
an upper strut (2), a vertical strut (3) and a support strut (4), on or at which the load (14) can be arranged, wherein
the upper strut (2) and the vertical strut (3) are rigidly connected to one another;
the support strut (4) is connected in a rotatably mounted manner to the vertical strut (3), so that a clear dimension (h) of a mouth (5) of the C-gripper (1) can be modified;
the vertical strut (3) is telescopable;
the telescopable vertical strut (3) is locked by means of a holding device (6); and
the rotatably mounted support strut (4) is locked by means of at least one non-rigid loading means (7) which, displaced relative to the vertical strut (3) in the direction of the mouth (4) of the C-gripper (1), is arranged at the upper strut (2) and the support strut (4); and
the support strut (4) is arranged at a right angle to the telescopic strut (3).

* * * * *